United States Patent [19]

Jones et al.

[11] Patent Number: 4,858,707

[45] Date of Patent: Aug. 22, 1989

[54] CONVEX SHAPED DIAMOND CUTTING ELEMENTS

[75] Inventors: Kenneth W. Jones, Kingwood; George Fyfe, Spring, both of Tex.

[73] Assignee: Smith International, Inc., Houston, Tex.

[21] Appl. No.: 221,410

[22] Filed: Jul. 19, 1988

[51] Int. Cl.[4] ..... E21B 10/46

[52] U.S. Cl. ..... 175/329; 175/410

[58] Field of Search ..... 175/327, 329, 410, 411; 76/108 A

[56] References Cited

U.S. PATENT DOCUMENTS

| | | | |
|---|---|---|---|
| 4,109,737 | 8/1978 | Bovenkerk | 175/410 X |
| 4,244,432 | 1/1981 | Rowley et al. | 175/329 |
| 4,350,215 | 9/1982 | Radtke | 175/410 X |
| 4,529,048 | 7/1985 | Hall | 175/329 X |
| 4,570,726 | 2/1986 | Hall | 175/410 |
| 4,593,777 | 6/1986 | Barr | 175/379 |
| 4,604,106 | 8/1986 | Hall et al. | 51/293 |

FOREIGN PATENT DOCUMENTS

| | | | |
|---|---|---|---|
| 2188354 | 9/1987 | United Kingdom | 175/329 |

OTHER PUBLICATIONS

Megadiamond Industries Brochure, Oct. 1981.

*Primary Examiner*—Jerome W. Massie, IV
*Assistant Examiner*—David J. Bagnell
*Attorney, Agent, or Firm*—Robert G. Upton

[57] ABSTRACT

A diamond insert for a rotary drag bit consists of an insert stud body that forms a first base end and a second cutter end. The cutter end of the insert is formed in a convex or spherical shape of polycrystalline diamond material. The convex layer of diamond is oriented relative to an axis of the stud body with a negative rake angle from 0° to about 45° inclusive.

5 Claims, 2 Drawing Sheets

CONVEX SHAPED DIAMOND CUTTING ELEMENTS

BACKGROUND OF THE INVENTION

1. Field of the Invention

This invention relates to polycrystalline diamond cutters mounted to insert studs that are mounted within the body of a rotary drag bit.

More particularly, this invention relates to polycrystalline diamond cutting elements that are formed in a convex shape and mounted to tungsten carbide studs that are subsequently secured within insert holes formed within the cutting face of a rotary drag bit.

2. Description of the Prior Art

Flat diamond cutting disks or elements mounted to tungsten carbide substrates are well-known in the prior art. Insert blanks or studs, for example, are fabricated from a tunsten carbide substrate with a diamond layer sintered to a face of the substrate, the diamond layer being composed of a polycrystalline material. The synthetic polycrystalline diamond layer is manufactured by the "Specialty Material Department of General Electric Company of Worthington, Ohio". The foregoing drill cutter blank goes by the trademark name "Statapax Drill Blanks". The Stratapax cutters, typically, are comprised of a flat thin diamond disk that is mounted to a cylindrical substrate which in turn is brazed to a tungsten carbide stud. Typically, the Stratapax blanks are strategically secured within the face of a rotary drag bit such that the cutting elements cover the bottom of a borehole to more efficiently cut the borehole bottom thereby advancing the drag bit in a borehole.

Drag bits with strategically placed Stratapax type inserts in the face of the bit also require a generous supply of coolant liquid to cool and clean the Stratapax cutters as they work in a borehole. It is well-known in the drag bit art that if diamond material is exposed for a prolonged time in a borehole without adequate cooling, the overheated diamond will convert to graphite.

Since the polycrystalline diamond disk of the Stratapax cutter is flat, the detritus or debris from the borehole bottom tends to pile up against the face of the diamond cutter thereby inhibiting a flow of coolant past the cutting face of the cutter thereby interfering with the cooling effect of the liquid against the cutting face of each of the diamond cutters.

U.S. Pat. No. 4,570,726 describes cutter elements for drag-type rotary drill bits which consists of forming an abrasive face contact portion into a curved shape. The curved shape directs the loosened material to the side of the contact portion of the abrasive element. The curve however, is in one plane so that the rake angle, with respect to a centerline of a drag bit, is constant thereby providing a stagnation point along this plane which would tend to ball or jam the cutter as it works in a borehole.

Principles of heat transfer and fluid dynamics teach that the convection heat transfer coefficient for a body, such as a cutting element for a drag bit, passing through a fluid varies greatly depending on the shape of the body. Planar faces having fluid flowing normal to them are among the least effective at convective cooling in the fluid. This result is caused in part by the stagnation layer in the fluid that is set up against the working surface of the cutting element. Since the insert, as taught by this invention, has a constant planar surface or rake angle, the cooling effect of the fluid along this plane would be somewhat minimized.

The polycrystalline cutting element of the present invention is spherically shaped, rather than just a curved planar surface. The rake angle, whether it is in a substantially vertical plane or a horizontal plane is constantly variable, thus the convex cutting element moves through a liquid medium with the greatest possible transfer of heat from the diamond cutting face to the fluid. The spherical cutting element of the present invention would have a definite advantage over the foregoing invention.

U.S. Pat. No. 4,593,777 describes a stud type cutting element having a diamond cutting face, the cutting face being adapted to engage an earth formation and cut the earth formation to a desired three-dimensional profile. The cutting faces defined a concave planar surface in one embodiment which has back rake angles which decrease from the distance from the profile. While the rake angle changes with penetration of the insert in a formation it changes in only the vertical plane, the horizontal plane remains constant, thus detritus would tend to pile up in front of this concave planar surface. Another embodiment discloses an insert having a circular concave surface with a negative rake angle with respect to a formation bottom. This type of insert would direct the detritus towards the center of the cutting element, thus balling the face of the cutting element, thereby detracting from the efficiency of the cutter and adding to its destruction by preventing adequate cooling of fluid to the cutting face.

The present invention teaches the use of a convex or spherical diamond cutting surface that has infinitely changing rake angles, both in the vertical and the horizontal plane. The curved surfaces provide maximum cutting capability and maximum cooling efficiencies since detritus is moved away from the center of the inserts in all planes. The rake angle is constantly variable as the penetration varies during operation of the drag bit in a borehole.

SUMMARY OF THE INVENTION

It is an object of this invention to provide a polycrystalline diamond cutting element having a convex spherical shape to the polycrystalline cutter.

More particularly, it is an object of this invention to provide a studded polycrystalline diamond cutter element with a spherically shaped diamond cutting face that has infinitely variable positive and negative rake angles, both in the vertical and the horizontal plane.

Yet another object of the present invention is the constantly changing negative rake angle in the vertical plane as the diamond cutter wears during operation of the bit in a borehole.

Another object of the present invention is better heat dissipation due to the spherical shape of the diamond cutter element, the detritus being moved away from the center of the convex cutter face, thus allowing a coolant to better cool and clean the diamond during operation of the bit in a borehole.

Another object of the present invention is that the domed, or curved, convex shape tends to extrude ultrasoft formations to their elastic limit so that they may be more readily cut.

Another advantage of the present invention is due to the convex shape there is less tendency of the bit to ball up during operation of the bit in a borehole.

A diamond rotary drag bit consisting of a drag bit body forms a first opened pin end that is adapted to threadably engage a drilling string. The drag bit body, at a second end forms a cutter face, the cutter face forming a multiplicity of strategically positioned diamond insert holes adapted to retain diamond insert studs therein. The diamond inserts form a first hardmetal cylindrically shaped base end and a second cutter end. The drag bit body further forms an internal chamber which communicates with the open pin end of the bit body. One or more strategically positioned nozzles are secured within the cutting face of the bit body. The nozzles communicate between the interior chamber and an exterior area adjacent the cutting face end of the bit body.

A convex polycrystalline element is adapted to be secured to a cutter end of the diamond insert stud. The convex cutter element is oriented relative to a centerline of the cylindrical stud end with a rake angle of from 0° to 45° inclusive. The convex or spherical cutter element forces detritus from an earth formation away from the center of the convex surface of the cutting element during a borehole drilling operation. The spherical or convex shape of the cutter element reduces frictional loads, minimizes balling of the cutting face of the bit and increases the diamond cooling and cleaning capacity of a drilling fluid exiting the one or more nozzles secured within the cutting face of the bit body.

The convex cutter element consists of a convex layer of polycrystalline diamond material bonded to a cylindrical hardmetal backup portion such as tungsten carbide. The backup cylinder forms a first convex surface which is bonded to the polycrystalline diamond layer. The base of the backup material for the diamond is metallurgically bonded to the cutting end of the stud which is secured to the cutting face of the drag bit. The convex cutter element is typically brazed to the insert stud portion.

Each of the multiplicity of strategically positioned diamond inserts mounted within the insert holes formed by the cutter face of the bit body is oriented with the convex polycrystalline cutter element faced toward the direction of rotation of the diamond drag bit. The center of the convex curved surface therefore, of each of the cutter elements is substantially coincident with a radius line of the cutter face, thus providing both positive and negative side rake to the cutter elements. This orientation allows each of the cutter elements to engage the earth formation with less friction, the positive and negative side rake angles forces debris toward both sides of each cutter element affecting efficient cooling and cleaning of the cutter cutting face of the diamond drag bit.

An advantage then, of the present invention over the invention prior art is the ever changing rake angle of the convex polycrystalline cutter element both in the vertical and horizontal plane to efficiently penetrate a formation while directing loosened debris away from the advancing curved surface of the cutter element.

Another advantage of the present invention over the prior art is the better heat dissipation of the convex cutter element due to the mechanism of moving the debris away from the convex cutting face, thereby exposing the curved surface to the cooling fluid exiting nozzles formed in the drag bit face.

Still another advantage of the present invention over the prior art is the mechanism of extruding ultrasoft formations to their elastic limit so that they may be subsequently cut by trailing inserts. A conventional drag bit would tend to spin on these earth formations even though the bit may not be balled up.

The above-noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
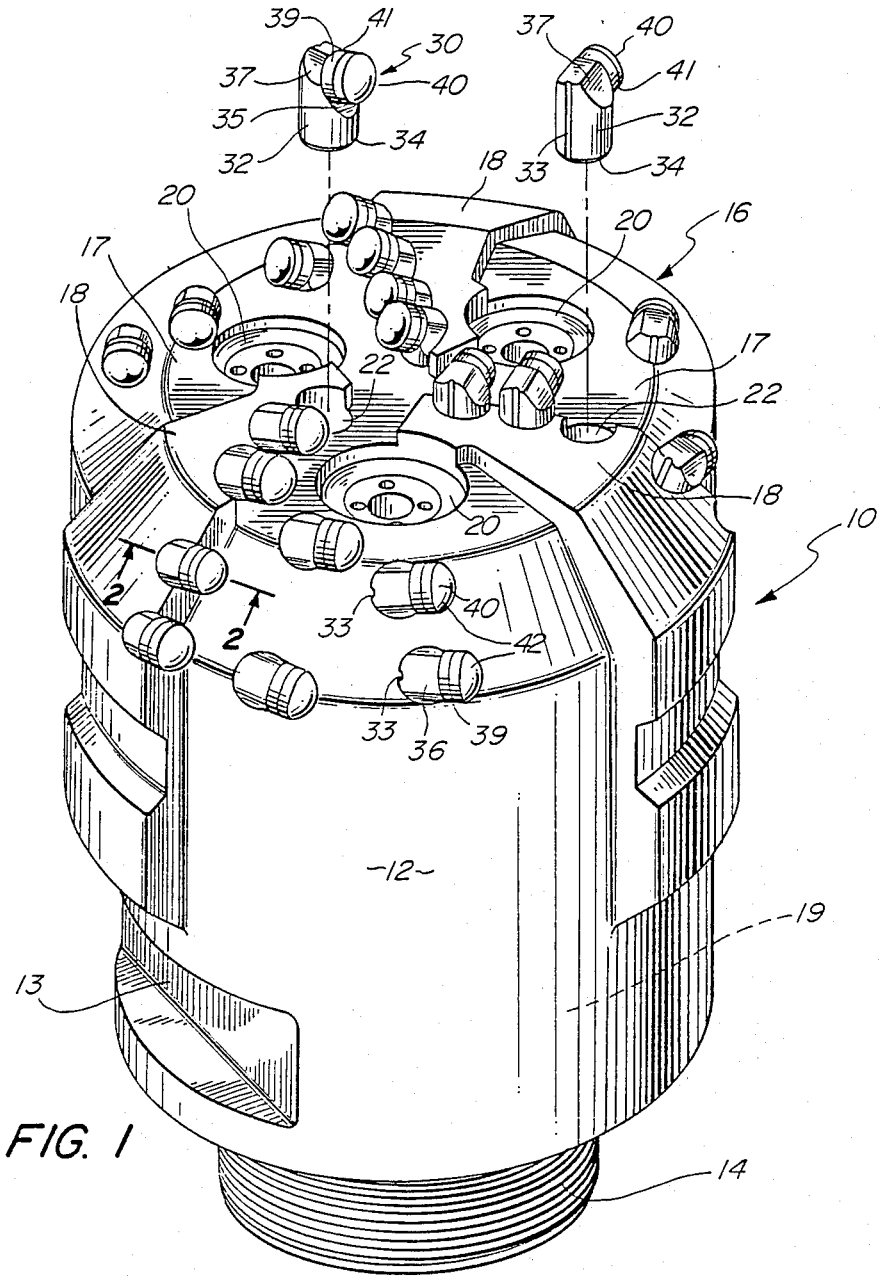
FIG. 1 is a perspective view of a diamond rotary drag bit with two of the insert studs exploded from the cutting face of the drag bit.

Turning now to the perspective view of FIG. 1, the diamond rotary drag bit, generally designated as 10, consists of drag bit body 12, pin end 14 and cutting end generally designated as 16. The threaded pin end of the rotary drag bit is typically connected to a rotary drilling string (not shown). The drilling string normally supplies a liquid commonly known as "mud" to the interior chamber 19 formed by bit body 12 (not shown). The mud directed to chamber 19 is accelerated out of one or more nozzles 20 positioned within face 17 of cutting end 16. A multiplicity of insert retention holes 22 are strategically positioned within the cutting face 17 of bit body 12. Three raised ridges 18 positioned 120 degrees, one from the other, serve to backup the inserts inserted within insert holes 22. The ridges additionally serve to direct hydraulic fluid accelerated through nozzles 20 past the cutting face of the inserts.

The diamond cutting inserts generally designated as 30 consist of insert stud body 32 which forms a base end 34 and a cutting end 36. The studs are generally fabricated from a hardmetal such as tungsten carbide. At the cutting end 36 of stud body 32 is formed a mounting surface 35 for mounting of the polycrystalline diamond cutter 40. The polycrystalline diamond cutting element 40 comprises a convexly shaped diamond layer 40 bonded to a generally cylindrical diamond backup support 39. The backup support at its base end is typically brazed at juncture 41 to surface 35 of stud body 32. The inserts 30 may be interference fitted within insert retention holes 22 formed in face 17 of the bit body. The outside diameter of the stud body 32 is slightly larger than the diameter of the insert retention hole 22, hence, a great deal of pressure is required to press the inserts 30 within their retention holes 22.

Alternatively, the stud bodies 32 may be metallurgically bonded within the insert retention holes 22 without departing from the scope of this invention. A slot 33 paralleling the axis of the stud body 32 serves to align the stud body accurately to position the cutting face such that it will most efficiently cut an earth formation during operation of the drag bit in a borehole.

Figure 3:
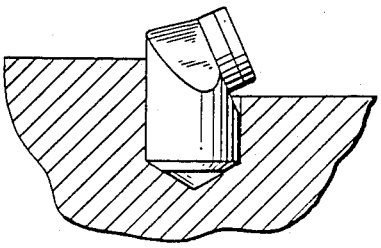
FIG. 3 PRIOR ART
FIG. 3 is a partially cutaway cross-section of a drag bit of the prior art illustrating a Stratapax type insert having a flat polycrystalline disk bonded to the cutting end of the stud of the insert.
Figure 2:
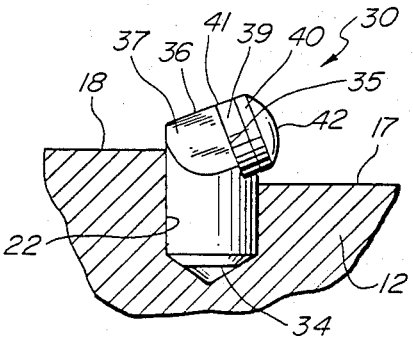
FIG. 2 is a partially cutaway cross-section taken through 2—2 of FIG. 1 illustrating a diamond insert with spherically shaped, cutting face mounted to the insert stud.
Figure 5:
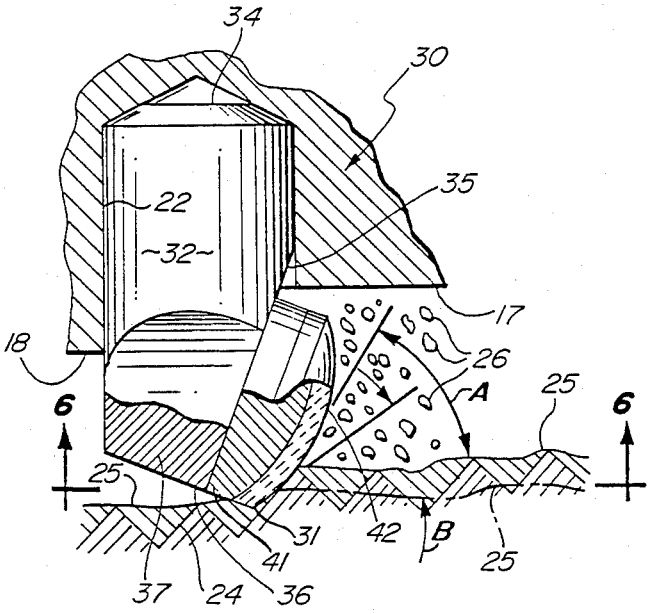
FIG. 5 is a partially broken away cross-section of the cutting end of a drag bit illustrating the insert of the present invention with the convex cutting face contacting and earth formation, the negative rake angles of which varies depending upon the depths of penetration of each of the multiplicity of the inserts mounted in the face of the drag bit.

Turning now to FIG. 3, the insert generally designated as 30 is more clearly shown inserted within an insert hole 22 formed in cutting face 17 of the bit body 12. The convex, or spherically shaped, polycrystalline layer secured to diamond backup support cylinder 39 and is fabricated by a known process. The convex polycrystalline diamond compact cutter is fabricated by a patented process (U.S. Pat. No. 4,604,106) assigned to the same assignee as the present application and incorporated hereby by reference. The polycrystalline diamond layer is formed in a convex shape such that the rounded surface serves to move debris away from this most advanced surface 42 as the insert is advanced rotationally through the formation 25 (see FIG. 5). The backup support cylinder generally fabricated from tungsten carbide is bonded at juncture 41 between the backup support 39 and surface 35 through, for example, a braze bond. The diamond cutting element 40 is tilted rearward at an angle from 0° to 45° inclusive to give the necessary clearance between heel 37 of the cutter body 32 and the surface 25 of the earth formation 24 (FIG. 5). Generally, this back rake angle, or negative rake angle, is determined by the physical characteristics of the formations being drilled.

The prior art shown in FIG. 3 illustrates a state-of-the-art Stratapax type cutter heretofore mentioned that has a flat polycrystalline diamond disk mounted to a cylindrical substrate that is in turn brazed to a tungsten carbide insert stud, the stud, of course, being pressed into an insert hole in the face of a drag bit. Stratapax type cutters of the prior art tend to ball up because the detritus piles up against the flat face of the diamond disk, thus inhibiting coolant flow across the cutting face of the insert while inhibiting the progress of the drag bit in a borehole.

Figure 4:
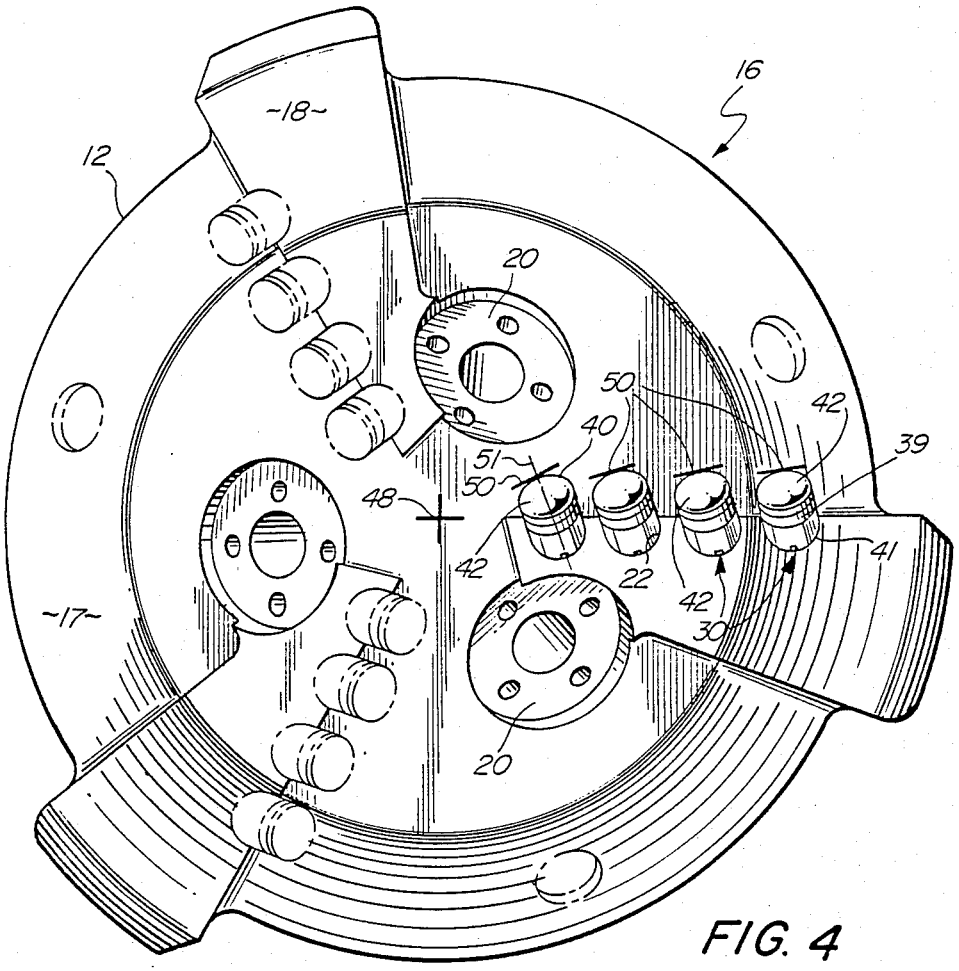
FIG. 4 is a partially broken end view of the cutting face of the rotary drag bit illustrating the specific orientation of the multiplicity of diamond inserts, each of the inserts having a rounded cutting face facing the direction of rotation of the drag bit.

Turning now to FIG. 4, the end view of the diamond rotary drag bit illustrates the careful orientation of each of the insert studs 32 within their insert retention holes 22 formed in face 17 of bit body 12. Each polycrystalline curved diamond cutting face 42 is oriented towards the direction of drag bit rotation 49 such that the centerline 51 of the diamond backup support cylinder 39 is oriented substantially 90° through a radial line from the central axis 48 of bit body 12. In other words, there is no skew of the diamond face 42 with respect to a radial line 50 of the insert. The cutters 30 are mounted so that a radial line 50 is tangent to the centers of the convex surface 42. Centerline 51 of cylinder 39 through curved surfaces 42 of the diamond cutter face is coincident with the radius line 50 of the bit face 17. This cutter orientation in effect provides both positive and negative side rake angles to the cutters 30. Thus, the rounded polycrystalline diamond cutting face allows the cutters to engage and drill the earth formation 24 with considerably less friction than that which would take place with the state-of-the-art flat Stratapax cutters shown in FIG. 3. This double side rake angle orientation forces the rock cuttings, or detritus, to both sides of the cutting face 42, thus automatically clearing the diamond cutting face to effect better cooling and cleaning of the polycrystalline diamond as heretofore stated. The rounded cutting face 42 reduces friction for a given amount of earth formation removed and significantly lowers the torque imparted to the drill string as compared to the flat faced Stratapax type cutters.

Of course, the reduced friction significantly reduces the heat buildup in the polycrystalline diamond layer, thereby minimizing any thermal degradation as compared, again, to the normal flat faced type diamond cutters. This slower thermal degradation rate keeps the cutters intact and sharp measurably longer than state-of-the-art cutters under like conditions. In addition, an added advantage is that the rounded, or spherically shaped, diamond cutters inherently are stronger in both impact and shear than are normal state-of-the-art flat faced cutters.

Turning, specifically, now to FIG. 5 the partial cross-section of the insert 30 illustrates the insert working in an earth formation 24. The outer peripheral cutting edge 31, in direct contact with the surface 25 of the earth formation 24, is at a negative rake angle "D" this angle being approximately 45° negative rake angle relative to surface 25 of earth formation 24. As the insert 30 penetrates further, or conversely, is worn further, the negative rake angle lessens as shown by angle "A" thus offering a different negative rake angle as the insert 30 works in a borehole. Since the surface 42 of the convex diamond cutting face is rounded, the debris, or detritus 26, is directed away from the most advanced portion of the curved surface indicated as 42. Thus, it can be readily realized that the detritus will not backup against the curved surface since the curved surface moves the debris away in all directions from the curved surface 42 of the insert 30.

Figure 6:
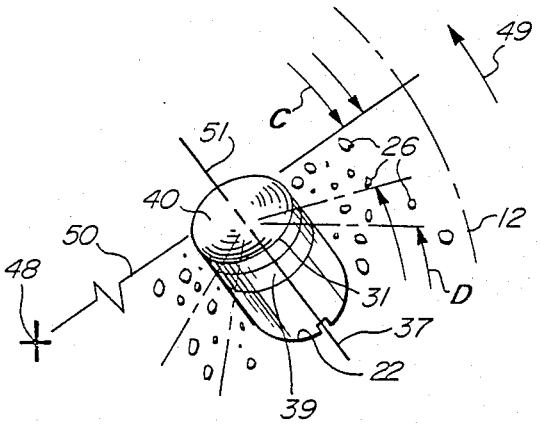
FIG. 6 is a view taken through 6—6 of FIG. 5 illustrating a single diamond cutter insert, the center of the curved diamond cutting element being precisely oriented such that a line tangent to the center of the curved surface of the diamond cutter face is coincident with a radius line of the bit face.

Turning now to FIG. 6 the precise orientation of the diamond cutters 30 with respect to a radial line emanating from a centerline 48 of the bit body 12 such that a centerline of the stud body 39 precisely intersects the radial line 50, 90° to the radial line 50 thereby assuring that the most advanced portion of the curved surface 42 is directed equally into the formation so that the detritus 26 is pushed along side rake angle represented by angles "C" and angles "D" dependent upon the depth of penetration of cutting edge 31 on the periphery of he curved diamond cutter element 40.

As mentioned before, as each of the diamond inserts 30 vary in their penetration of the formation 24 these side rake angles will be infinitely variable dependent upon the depth of penetration, thus assuring that the detritus is continually moved away from the rounded surface. Additionally, as the inserts wear, the side rake angles will vary as will the angles "a" and "b" as shown in FIG. 4. The infinitely variable side rake angles and vertical rake angles assures constant movement of the debris away from the cutting face, thus improving penetration rates of the drag bit in the formation 24.

It would be obvious to fabricate an insert with a convex polycrystalline cutter element oriented relative to a centerline of the insert stud with a positive rake angle (not shown).

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A polycrystalline diamond insert comprising:

a cylindrical shaped hardmetal insert stud body forming a first base end and a second cutter end, said second cutter end comprising a cutter element formed in a convex shaped layer of polycrystalline diamond, said convex cutter element further comprises a substantially constant thickness, convex layer of polycrystalline diamond material bonded to a substantially cylindrical hardmetal backup portion, said backup portion forming a first convex surface bonded to said layer of diamond and a second base end, said second base end being metallurgically bonded to said second cutter end of said insert stud, said convex layer of diamond is oriented relative to a centerline of said cylindrical stud with a negative rake angle from 0° to about 45°, inclusive, said convex cutter element forces detritus from a working surface of a material away from the center of the convex surface thereby continuously clearing said convex cutter surface of detritus to enhance cooling said cutter surface during a cutting operation of said insert.

2. The invention as set forth in claim 1 wherein said convex shaped cutter element is a portion of a sphere.

3. The invention as set forth in claim 1 wherein said rake angle relative to said working surface of said material is negative.

4. The invention as set forth in claim 3 wherein said side rake angle relative to said working surface of said material is positive.

5. A diamond rotary drag bit comprising:

a drag bit body forming a first opened pin end adapted to threadably engage a drilling string, and a second cutter face, said second cutter face forms a multiplicity of strategically positioned diamond insert holes adapted to retain diamond insert studs therein, said diamond inserts forming a first hardmetal cylindrically shaped base end and a second cutter end, said bit body further forms an internal chamber, said chamber communicates with said first opened pin end and one or more strategically positioned nozzles, said nozzles communicate between said chamber and an exterior area adjacent said second cutting face of said bit body, a source of drilling fluid; and convex polycrystalline diamond cutter elements adapted to be secured to said second cutter end of said diamond insert stud, said convex cutter element comprises a substantially constant thickness, convex layer of polycrystalline diamond material bonded to a substantially cylindrical hardmetal backup portion, said backup portion forming a first convex surface bonded to said layer of diamond and a second base end, said second base end being metallurgically bonded to said second cutter end of said insert stud, said convex cutter element is oriented relative to a centerline of said cylindrically shaped base end with a negative rake angle from 0° to about 45°, inclusive, each of said multiplicity of strategically positioned diamond inserts mounted within said insert holes formed by said second cutter face of said bit body is oriented with the convex polycrystalline cutter element face toward the direction of rotation of the diamond drag bit such that a center of the convex curved surface of each of the cutter elements is substantially coincident with a radius line of the cutter face thus providing both positive and negative side rake angles to the cutter elements thereby allowing each cutter element to engage the earth formation with less friction, the positive and negative side rake angles force detritus toward both said of each cutter element effecting efficient cooling and cleaning of the cutting face of the diamond drag bit, said convex cutter element forces detritus from an earth formation away from a center of the convex surface of said cutting element during a borehole drilling operation thereby reducing frictional loads, minimizing ralling of the second cutting face of the bit and increasing the diamond cooling and cleaning capacity of said source of drilling fluid exiting said one or more nozzles secured within said cutting face.

* * * * *